US010513667B2

(12) United States Patent
Carney et al.

(10) Patent No.: US 10,513,667 B2
(45) Date of Patent: Dec. 24, 2019

(54) 2-STROKE INTERNAL COMBUSTION ENGINE CYLINDER LINER LUBRICATING COMPOSITION

(71) Applicant: The Lubrizol Corporation, Wickliffe, OH (US)

(72) Inventors: Shaun P. Carney, Aston on Trent (GB); David M. Hobson, Staffordshire (GB)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 0 days.

(21) Appl. No.: 14/783,557

(22) PCT Filed: Apr. 7, 2014

(86) PCT No.: PCT/US2014/033120

§ 371 (c)(1),
(2) Date: Oct. 9, 2015

(87) PCT Pub. No.: WO2014/172125

PCT Pub. Date: Oct. 23, 2014

(65) Prior Publication Data

US 2016/0060562 A1 Mar. 3, 2016

Related U.S. Application Data

(60) Provisional application No. 61/812,878, filed on Apr. 17, 2013.

(51) Int. Cl.

| | |
|---|---|
| ***C10M 129/54*** | (2006.01) |
| ***C10M 141/08*** | (2006.01) |
| ***C08K 5/01*** | (2006.01) |
| ***C10M 161/00*** | (2006.01) |
| ***C10M 165/00*** | (2006.01) |

(52) U.S. Cl.

CPC ..... *C10M 161/00* (2013.01); *C10M 165/00* (2013.01); *C10M 2207/027* (2013.01); *C10M 2209/104* (2013.01); *C10M 2209/105* (2013.01); *C10M 2209/107* (2013.01); *C10M 2209/108* (2013.01); *C10M 2209/1036* (2013.01); *C10M 2215/28* (2013.01); *C10M 2219/046* (2013.01); *C10N 2220/021* (2013.01); *C10N 2230/02* (2013.01); *C10N 2230/04* (2013.01); *C10N 2230/52* (2013.01); *C10N 2240/102* (2013.01); *C10N 2240/105* (2013.01)

(58) Field of Classification Search

CPC . C10M 125/24; C10M 139/06; C10M 135/20
USPC ..... 508/516, 391
See application file for complete search history.

(56) References Cited

U.S. PATENT DOCUMENTS

| | | | | |
|---|---|---|---|---|
| 2,739,126 | A | 3/1956 | Benbury et al. | |
| 4,402,845 | A | 9/1983 | Zoleski et al. | |
| 2009/0305924 | A1* | 12/2009 | Mayhew | C10M 129/93 508/306 |

FOREIGN PATENT DOCUMENTS

| | | | |
|---|---|---|---|
| WO | 1999064543 | A1 | 12/1999 |
| WO | 2004053031 | A1 | 6/2004 |
| WO | 2008021737 | A1 | 2/2008 |

* cited by examiner

*Primary Examiner* — Prem C Singh
*Assistant Examiner* — Francis C Campanell
(74) *Attorney, Agent, or Firm* — Iken Sans; Teresan Gilbert

(57) ABSTRACT

The present invention provides a lubricating composition comprising: an oil of lubricating viscosity; 3 wt % to 30 wt % of an alkaline earth or alkali metal sulphonate detergent; and an oil-soluble polyalkylene glycol having a distribution of molecular weight such that the molecules thereof have a weight of 2500 to less than 10,000 Daltons and comprise 0.05 wt % to 3 wt % of the lubricating composition. The invention further provides a method of lubricating a 2-stroke internal combustion engine cylinder liner (and piston) with the lubricating composition.

6 Claims, No Drawings

2-STROKE INTERNAL COMBUSTION ENGINE CYLINDER LINER LUBRICATING COMPOSITION

CROSS REFERENCE TO RELATED APPLICATION

This application claims priority from PCT Application Serial No. PCT/US2014/033120 filed on Apr. 7, 2014, which claims the benefit of U.S. Provisional Application No. 61/812,878 filed on Apr. 17, 2013.

FIELD OF INVENTION

The present invention relates to a lubricating composition comprising: an oil of lubricating viscosity; 3 wt % to 30 wt % of an alkaline earth or alkali metal sulphonate detergent; and an oil-soluble polyalkylene glycol having a distribution of molecular weight such that the molecules thereof have a weight of 2500 to less than 10,000 Daltons and comprise 0.05 wt % to 3 wt % of the lubricating composition. The invention further provides a method of lubricating a 2-stroke internal combustion engine cylinder liner (and piston) with the lubricating composition disclosed wherein.

BACKGROUND OF THE INVENTION

Lubricant compositions are known to provide a lubricating oil film between different components within an internal combustion engine. The lubricating oil film is known to improve oxidative and thermal stability, to help reduce corrosive and adhesive wear. In addition the lubricant compositions help impart cleanliness to the engine and associated engine components (such as a 2-stroke internal combustion engine cylinder liner (and piston)). One of the important features that lubricants have that help in protecting the engine is the lubricating oil film "thickness," i.e., viscosity. However, for a lubricant to perform at an optimum level, the oil film thickness has to provide a balance between being thin enough to spread efficiently over a surface but yet thick enough to provide a continuous film that does not readily evaporate when exposed to engine operating temperatures.

Control of lubricant thickness has been achieved by employing a wide variety of polymeric viscosity modifiers and/or bright stock. Polymeric viscosity modifiers include, for example, polymethacrylates, polyolefins and polyisobutylenes. International Publication WO 99/64543 (Carey et al., published 16 December 1999), for example, discloses diesel cylinder oil having a viscosity index of at least 95 and a total base number of at least 40 mg KOH/g. The oil further contains 1 wt % to 20 wt % of a liquid polyisobutylene having a viscosity from 1500 to 8000 $mm^2/s$ at 100° C. However, viscosity modifiers are believed to increase piston deposit levels.

Bright Stock is a lubricating oil component of high viscosity typically obtained from residues of petroleum distillation. Bright stock has been utilized in many lubricants, particularly those requiring SAE 50 (16.3 $mm^2/s$ to 21.9 $mm^2/s$) viscosities, bright stock is believed to provide a lubricant with reduced oxidative or thermal stability. However, the availability of bright stock is diminishing, resulting in high volume uses such as those for 2-stroke or 4-stroke marine or stationary power engines requiring alternative solutions to impart the desired viscometrics in lubricants.

International publication WO 2008/021737 (Cook et al. published 21 February 2008) discloses a method of lubricating an internal combustion engine with a power output of at least 1600 kilowatts, comprising supplying to the internal combustion engine a lubricating composition comprising (a) an oil of lubricating viscosity and (b) at least 0.5 wt % of a carboxylic acid or an anhydride thereof, wherein the carboxylic acid or anhydride thereof has a hydrocarbyl group of at least about 10 carbon atoms. Also disclosed in a long list of corrosion inhibitors is the possibility to include Synalox® corrosion inhibitor. The Synalox® corrosion inhibitor is typically a homopolymer or copolymer of propylene oxide. However, there is no teaching towards the selection of the Synalox® corrosion inhibitor over other corrosion inhibitors.

SUMMARY OF THE INVENTION

An objective of the present invention is to provide a lubricating composition capable of lubricating an internal combustion engine, especially a 2-stroke marine cylinder liner (and piston) or stationary power engine cylinder liner (and piston). The lubricating composition may be capable of providing at least one property from control of viscometrics, increased thickening, acceptable deposit accumulation, reduced wear, reduced corrosion (typically iron), acceptable oxidative stability and a partial or complete replacement for thickeners (such as viscosity modifiers or bright stock).

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

The present invention also comprises polyalkylene glycol in the form of an oil-soluble polyalkylene glycol material. By "oil-soluble" is meant a material which will dissolve or disperse on a macroscopic or gross scale in an oil or hydrocarbon, as the case may be, typically a mineral oil, such that a practical solution or dispersion can be prepared. In order to prepare a useful lubricant formulation, the oil soluble polyalkylene glycol material should not precipitate or settle out over a course of several days or weeks. Such materials may exhibit true solubility on a molecular scale or may exist in the form of agglomerations of varying size or scale, provided however that they have dissolved or dispersed on a gross scale.

The invention relates to a lubricating composition comprising: an oil of lubricating viscosity; 3 wt % to 30 wt % of an alkaline earth or alkali metal sulphonate detergent; and an oil-soluble polyalkylene glycol having a distribution of molecular weight such that the molecules thereof have a weight of 2500 to less than 10,000 Daltons and comprise 0.05 wt % to 3 wt % of the lubricating composition.

In one embodiment the lubricating composition comprises an oil of lubricating viscosity; 4 wt % to 25 wt % of the alkaline earth or alkali metal sulphonate detergent; and an oil-soluble polyalkylene glycol having a distribution of molecular weight such that the molecules thereof have a weight of 2500 to less than 10,000 Daltons and comprise 0.15 wt % to 1.5 wt % of the lubricating composition.

In one embodiment the lubricating composition comprises an oil of lubricating viscosity; 4 wt % to 25 wt % of the alkaline earth or alkali metal sulphonate detergent; and an oil-soluble polyalkylene glycol having a distribution of molecular weight such that the molecules thereof have a weight of 2500 to less than 10,000 Daltons and comprise 0.2 wt % to 1 wt % of the lubricating composition.

The distribution of molecular weight of the oil-soluble polyalkylene glycol is determined by GPC (gel permeation chromatography) using twelve polystyrene standards with peak molecular weights ranging from 350 to 2,000,000. The GPC uses columns described as (i) 3×PLgel 5 μm Mixed C (exclusion limit ~6M); 300×7.5 mm and (ii) 1×PLgel 5 100 Å 300×7.5 mm. The standard calibration has a correlation coefficient of greater than 0.998. The GPC uses a refractive index detector, a mobile phase of THF (tetrahydrofuran), and the column temperature is 40° C. The column setting is for a flow rate of 1 ml/min, injection volume of 300 μl; and sample concentration is 7.5 mg polymer to 1.0 ml THF.

Where the term distribution of molecular weight is applied to compositions having a distribution of molecular weight molecular weight it should be understood that the weight average molecular weight be within five percent of the reported nominal value for polyalkylene glycols with a reported value of less than 1000 g/mol, within 10% for reported values between 1000 and 7000 g/mol and within 12.5% for reported values greater than 7000 g/mol. For example, a polymer composition described as having a distribution of molecular weight of 3000 g/mol should be construed to literally cover compositions with a distribution of molecular weight ranging from 2625 g/mol to about 3375 g/mol. Similar methodology is disclosed in paragraph [0026] of International Publication WO 2007/089238 (Thompson et al., published 9 Aug. 2007).

In one embodiment the invention relates to a method of lubricating a cylinder liner (and piston) of a 2-stroke internal combustion engine with a power output of at least 1600 kilowatts comprising supplying to the engine a lubricating composition comprising an oil of lubricating viscosity; 3 wt % to 30 wt % of an alkaline earth or alkali metal sulphonate detergent; and In one embodiment the lubricating composition comprises an oil of lubricating viscosity; 4 wt % to 25 wt % of the alkaline earth or alkali metal sulphonate detergent; and an oil-soluble polyalkylene glycol having a distribution of molecular weight such that the molecules thereof have a weight of 2500 to less than 10,000 Daltons and comprise 0.05 wt % to 3 wt % of the lubricating composition.

In one embodiment the invention relates to a method of lubricating a cylinder liner (and piston) of a 2-stroke internal combustion engine with a power output of at least 1600 kilowatts comprising supplying to the engine a lubricating composition comprising an oil of lubricating viscosity; 4 wt % to 25 wt % of the alkaline earth or alkali metal sulphonate detergent; In one embodiment the lubricating composition comprises an oil of lubricating viscosity; 4 wt % to 25 wt % of the alkaline earth or alkali metal sulphonate detergent; and an oil-soluble polyalkylene glycol having a distribution of molecular weight such that the molecules thereof have a weight of 2500 to less than 10,000 Daltons and comprise 0.15 wt % to 1.5 wt % of the lubricating composition.

In one embodiment the invention relates to a method of lubricating a cylinder liner (and piston) of a 2-stroke internal combustion engine with a power output of at least 1600 kilowatts comprising supplying to the engine a lubricating composition comprising an oil of lubricating viscosity; 4.5 wt % to 20 wt % of the alkaline earth or alkali metal sulphonate detergent; In one embodiment the lubricating composition comprises an oil of lubricating viscosity; 4 wt % to 25 wt % of the alkaline earth or alkali metal sulphonate detergent; and an oil-soluble polyalkylene glycol having a distribution of molecular weight such that the molecules thereof have a weight of 2500 to less than 10,000 Daltons and comprise 0.2 wt % to 1 wt % of the lubricating composition.

The internal combustion engine with a power output of at least 1600 kilowatts may be either a 2-stroke marine diesel engine or a 2-stroke stationary power engine.

The cylinder liner (and piston) in one embodiment may be a marine diesel cylinder liner (and piston).

In one embodiment the invention relates to the use of the oil-soluble polyalkylene glycol disclosed herein as a thickener or bright stock replacement additive in a lubricating composition for a 2-stroke internal combustion engine with a power output of at least 1600 kilowatts, wherein the lubricating composition is disclosed herein, wherein the lubricating composition lubricates the cylinder liner and piston.

The oil-soluble polyalkylene glycol disclosed herein may have a distribution of molecular weight such that the molecules thereof have a weight of 2750 to 9000, or 3000 to 8000, or 3000 to 7000 Daltons. In one embodiment the oil-soluble polyalkylene glycol may have a distribution of molecular weight such that the molecules thereof have a weight of 3000 to 7000 Daltons.

DETAILED DESCRIPTION OF THE INVENTION

The present invention provides a method of lubricating an internal combustion engine and a lubricating composition as disclosed above.

The lubricating composition may not be an emulsion. A person skilled in the art appreciates that an emulsion is a suspension of droplets of one liquid in a second liquid. By making an emulsion, one can mix two liquids that ordinarily do not mix well, such as oil and water.

As used herein the term "substantially free of, to free of" means that the substance in question (e.g., the bright stock) may be present from 0 wt % to 1 wt % of the lubricating composition.

In one embodiment the method employs a lubricating composition that may be substantially reduced (e.g., 0 to 30 wt %, or 0 to 15 wt %, or 0.1 to 10 wt %) in amount of bright stock compared with conventional amounts (typically 15 to 40 wt % of a lubricating composition). In one embodiment the lubricating composition may be substantially free of, to free of bright stock.

In one embodiment the method employs a lubricating composition that may contain 0 to 15 wt %, or 0.1 to 10 wt % of bright stock.

The lubricating composition may not contain an oxyalkylated alkylphenol.

In one embodiment the lubricating composition does not contain more than (and typically 0 wt % to 1 wt %, or 0 wt %) of a carboxylic acid or an anhydride thereof, wherein the carboxylic acid or anhydride thereof has a hydrocarbyl group of at least about 10 carbon atoms (such as polyisobutylene succinic acid or anhydride.

The lubricating composition may have a base number of 20 or higher, 30 or higher, 40 or higher or 70 or higher, or 20 to 100, or 30 to 100, or 40 to 100, or 70 to 100, or 20 to 70, or 30 to 70, or 40 to 70 mg KOH/g. For example the lubricating composition may have a base number of 70 to 100, or 20 to 40 mg KOH/g, although 70 to 100 is typical.

Oils of Lubricating Viscosity

The invention further includes oil of lubricating viscosity. The oil of lubricating viscosity may have a SAE grade of SAE 30, SAE 40, SAE 50, or SAE 60. The lubricating composition may be monograde, or multigrade, typically monograde.

In different embodiments the oil of lubricating viscosity may be a SAE 40 or SAE 50 oil.

A SAE 40 oil may have a kinematic viscosity of 12.5 $mm^2/s$ to 16.3 $mm^2/s$ at 100° C.

A SAE 50 oil may have a kinematic viscosity of 16.3 $mm^2/s$ to 21.9 $mm^2/s$ at 100° C. The oil of lubricating viscosity may have kinematic viscosity of at least 16.5 (or at least 17.5, or at least 18.5 or at least 19.5) $mm^2/s$ to 21.9 $mm^2/s$ at 100° C. In different embodiment the oil of lubricating viscosity may have kinematic viscosity of at least 16.5 18.5 or at least 19.5 $mm^2/s$ to 21.9 $mm^2/s$ at 100° C.

Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include but are not limited to liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil and mixtures thereof. Often the oil of lubricating viscosity is an API Group I, Group II, Group III, Group IV oil and mixtures thereof. Alternatively the oil of lubricating viscosity is often an API Group I, Group II, Group III oil or mixtures thereof.

Alkaline Earth or Alkali Metal Sulphonate Detergent

The lubricating composition of the invention includes an alkaline earth or alkali metal sulphonate detergent. The sulphonate detergent of the present invention is known in the art.

The alkaline earth or alkali metal sulphonate detergent may be neutral or overbased, typically overbased.

The sulphonate detergent may be present in an amount ranging from 4 wt % to 25 wt %, or 4.5 wt % to 20 wt % of the lubricating composition.

The alkaline earth or alkali metal delivered by the sulphonate detergent may be range from at 500 to 5000 ppm, or 1000 to 3000 ppm of the lubricating composition.

An overbased alkaline earth or alkali metal sulphonate detergent may have a TBN of 200 to 600 mg KOH/g, or 250 to 500 mg KOH/g or 300 to 450 mg KOH/g.

The alkaline earth or alkali metal sulphonate detergent may have metal ratio of 2:1 to 40:1, or 3:1 to 20:1.

The metal of the metal sulphonate detergent may be calcium, magnesium or sodium. In one embodiment the metal of the metal sulphonate detergent may be calcium.

The sulphonate detergent of the present invention may be represented by the formula: $(R^1)_k$-A-$SO_3M$ wherein each $R^1$ may be a hydrocarbyl group, typically each hydrocarbyl group may contain 6 to 40, or 8 to 35 or 12 to 30 carbon atoms; A may be independently a cyclic or acyclic divalent hydrocarbon group; M may be hydrogen, a valence of a metal ion, an ammonium ion or mixtures thereof; and k may be an integer of 0 to 5, for example 0, 1, 2, 3, 4, 5. In one embodiment k may be 1, 2 or 3, or 1 or 2. In one embodiment M may be hydrogen and typically present on less than 30%, or less than 20%, or less than 10% or less than 5% of the available M entities, the balance of the M entities being a metal or ammonium ion.

In one embodiment k is 1 and $R^1$ may be a branched alkyl group with 6 to 40 carbon atoms. In one embodiment k may be 1 and $R^1$ is a linear alkyl group with 6 to 40 carbon atoms.

Examples of suitable sulphonic acids capable of forming the overbased sulphonate detergent include polypropene benzene sulphonic acid, undecyl benzene sulphonic acid, dodecyl benzene sulphonic acid, tridecyl benzene sulphonic acid, tetradecyl benzene sulphonic acid, pentadecyl benzene sulphonic acid, hexadecyl benzene sulphonic acid and mixtures thereof. In one embodiment the sulphonic acid includes tridecyl benzene sulphonic acid, tetradecyl benzene sulphonic acid, octadecyl benzene sulphonic acid, tetracicosyl benzene sulphonic acid or mixtures thereof. In one embodiment of the invention the sulphonic acid is a polypropene benzene sulphonic acid, where the polypropene contains 18 to 30 carbon atoms.

In one embodiment of the invention the sulphonate components may be calcium polypropene benzenesulphonate and calcium monoalkyl and dialkyl benzenesulphonates wherein the alkyl groups contain at least 10 or 12 carbons, for example 11, 12, 13, 14, 15, 18, 24 or 30 carbon atoms.

When M is a valence of a metal ion, the metal may be monovalent, divalent, trivalent or mixtures of such metals. When monovalent, the metal M includes an alkali metal such as lithium, sodium, or potassium and when divalent, the metal M includes an alkaline earth metal such as magnesium, calcium or barium. In one embodiment the metal may be an alkaline earth metal. In one embodiment the metal is calcium.

When A is cyclic hydrocarbon group, suitable groups include phenylene or fused bicyclic groups such as naphthylene, indenylene, indanylene, bicyclopentadienylene or mixtures thereof. In one embodiment A comprises a benzene ring.

When A is an acyclic divalent hydrocarbon group, the carbon chain may be linear or branched. In one embodiment A may be an acyclic linear hydrocarbon group.

A sulphonate detergent with 500 TBN and its preparation are disclosed in U.S. Pat. No. 5,792,732. In Example 2 thereof, a 500 TBN all-linear alkylbenzene sulphonate is prepared by reacting an alkyl benzene sulphonate from Witco Corp. (now known as Chemtura) with $Ca(OH)_2$ and CaO in n-heptane and methanol and bubbling with $CO_2$. It is also reported in the aforementioned patent (col. 5) that a 500 TBN overbased sulphonate containing highly branched alkylbenzene sulphonate is available from Witco Corp. (now known as Chemtura) as Petronate® C-500. Another method for preparing an overbased sulphonate detergent of high metal ratio is disclosed in U.S. Pat. No. 6,444,625 (see, for instance, column 3, bottom).

In one embodiment the sulphonate detergent has a substrate of a hydrocarbyl substituted aryl sulphonic acid (or sulphonate), or mixtures thereof. The hydrocarbyl substituted aryl sulphonic acid may be synthetic or natural. The aryl group of the aryl sulphonic acid may be phenyl, tolyl or naphthyl. In one embodiment the hydrocarbyl substituted aryl sulphonic acid comprises alkyl substituted benzene sulphonic acid. In one embodiment the substrate of the sulphonate detergent may be a hydrocarbyl-substituted sulphonic acid, such as, polypropene benzenesulphonic acid, $C_{16}$-$C_{36}$ alkyl benzenesulphonic acid, and $C_{16}$-$C_{26}$ alkyl benzenesulphonic acid or mixtures thereof. The hydrocarbyl (especially an alkyl) group typically contains 8 to 30, or 10 to 26, or 10 to 15 carbon atoms. In one embodiment the surfactant is a mixture of $C_{10}$ to $C_{15}$ alkylbenzene sulphonic acids. Examples of sulphonates include dodecyl and tridecyl benzenes or condensed naphthalenes or petroleum, sulphosuccinates and derivatives.

In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof.

In one embodiment the sulphonate detergent may be a metal salt of one or more oil-soluble alkyl toluene sulphonate compounds as disclosed in paragraphs [0046] to [0053] of US Patent Application 2008/0119378.

The sulphonate detergent of the present invention may also include "hybrid" detergents formed with mixed surfactant systems including phenate and/or sulphonate components, e.g., sulphonate/phenates, sulphonate/salicylates, sulphonates/phenates/salicylates, as described, for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

A hybrid detergent may be prepared by hybrid preparing an overbased calcium detergent composed of a sulphonic acid and an alkyl phenol. A hybrid detergent may be prepared as disclosed in WO97046643 or by the following preparative Example.

Preparative Example 1: 540 g of toluene, 276 g of methanol and 290 g of the product of lime are mixed at ambient temperature in a vessel. Then 238 g of sulphurised alkyl phenol and 110 g of alkyl sulphonic acid (with molecular weight of 683) are charged along with 22 g of water and an additional 50 g of toluene at 40° C. After neutralization the vessel is cooled to 28° C. while 62 g of carbon dioxide is injected. The reaction temperature is increased to 60° C. over a period of 1 hour, before cooling to 28° C. 254 g of lime is added and a second carbonation step carried out, whilst heating to 60° C. over 90 minutes. The product of the reaction is cooled and filtered.

While not being bound by theory it is believed that the thickening technical effect observed by the present invention is due to an interaction between the alkaline earth or alkali metal sulphonate detergent and the oil soluble polyalkylene glycol.

Typically the lubricating composition of the invention includes an alkaline earth or alkali metal sulphonate detergent, wherein the detergent is a calcium sulphonate, and the TBN of the detergent is 300 to 500 mg KOH/g for example 300 or 400 or 450 mg KOH/g in combination with an oil soluble polyalkylene glycol may have a distribution of molecular weight such that the molecules thereof have a weight of 3000 to 7000 Daltons. Said lubricating composition may comprise an oil of lubricating viscosity; 3 wt % to 30 wt % of an alkaline earth or alkali metal sulphonate detergent; 0.2 wt % to 5 wt % of the oil-soluble polyalkylene glycol.

Polyalkylene Glycol

The oil soluble polyalkylene glycol may a homopolymer or a copolymer, typically a copolymer.

The oil soluble polyalkylene glycol may have random or block architecture.

The oil soluble polyalkylene glycol may be present in an amount of 0.1 wt % to 2 wt %, or 0.15 wt % to 1.5 wt %, or 0.2 wt % to 1 wt % 0.2 wt % to 0.5 wt % of the lubricating composition. In one embodiment the oil soluble polyalkylene glycol may be present at 0.2 wt % to 0.5 wt %.

The oil soluble polyalkylene glycol may have up to 150, up to 100, up to 75 or up to 50 oxyalkylene groups. For example, the number of oxyalkylene groups may be range from 10 to 150, or 20 to 100, or 25 to 75 or 30 to 50.

The oil soluble polyalkylene glycol copolymer may be obtained/obtainable from a mixture of:

(1) at least one alkylene oxide selected from the group consisting of ethylene oxide, propylene oxide, butylene oxide, pentylene oxide, hexylene oxide, heptylene oxide, and mixtures thereof; and (2) at least one alkylene oxide selected from the group consisting of octylene oxide, nonylene oxide, decylene oxide, undecylene oxide, dodecylene oxide, tridecylene oxide, tetradecylene, pentadecylene oxide, hexadecylene oxide, heptadecylene oxide, octadecylene oxide, nonadecylene oxide, eicosylene oxide, and mixtures thereof.

The oil soluble polyalkylene glycol (2) may be selected from the group consisting of decylene oxide, undecylene oxide, dodecylene oxide, tridecylene oxide, tetradecylene, pentadecylene oxide, hexadecylene oxide, heptadecylene oxide, octadecylene oxide, and mixtures thereof.

In one embodiment the oil soluble polyalkylene glycol comprises (i) a portion of oxyalkylene groups derived from ethylene oxide; and (ii) a portion of oxyalkylene groups derived from an alkylene oxide containing 3 to 8 carbon atoms.

The oil soluble polyalkylene glycol may have one or two terminal hydroxyl groups, or one terminal hydroxyl group and initiated with a mono-alcohol or a secondary amine. In one embodiment the oil soluble polyalkylene glycol of the present invention has one terminal hydroxyl group.

In one embodiment the oil soluble polyalkylene glycol of the present invention has one terminal hydroxyl group; and initiated with a mono-alcohol.

The oil soluble polyalkylene glycol copolymer may comprise units derived from Formula I:

Formula I

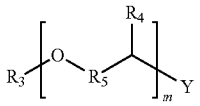

wherein:

$R_3$ may be hydrogen (H), —$R_6$OH, —$R_6NH_2$, —(C═O)$R_6$, —$R_6$—N(H)C(═O)$R_6$, or a hydrocarbyl group of from 1 to 30, or 1 to 20, or 1 to 15 carbon atoms, $R_4$ may be H, or a hydrocarbyl group of from 1 to 10 carbon atoms, $R_5$ may be a straight or branched hydrocarbyl group of from 1 to 6 carbon atoms, $R_6$ may be a hydrocarbyl group of 1 to 20 carbon atoms, Y may be $NR_7R_8$, OH, $R_6NH_2$ or $R_6$OH, $R_7$, and $R_8$, independently, may be H, or a hydrocarbyl group of from 1 to 50 carbon atoms in which up to one third of the carbon atoms may be substituted by N or functionalized with additional polyether of Formula I, and m may be an integer from 2 to 50, 3 to 40, or 5 to 30, or 10 to 25.

In one embodiment the oil soluble polyalkylene glycol comprises (i) 0.1 wt % to 80 wt % of ethylene oxide, and an alkylene oxide containing 3 to 8 carbon atoms present at 20 wt % to 99.9 wt % of the polyoxyalkylene glycol.

In one embodiment the oil soluble polyalkylene glycol comprises (i) 5 wt % to 60 wt % of ethylene oxide, and an alkylene oxide containing 3 to 8 carbon atoms present at 40 wt % to 95 wt % of the polyoxyalkylene glycol.

In one embodiment the oil soluble polyalkylene glycol comprises (i) 0 wt % to 40 wt % of ethylene oxide, and an alkylene oxide containing 3 to 8 carbon atoms present at 60 wt % to 100 wt % of the polyoxyalkylene glycol.

In one embodiment the oil soluble polyalkylene glycol comprises (i) 0 wt % to 20 wt % of ethylene oxide, and an alkylene oxide containing 3 to 8 carbon atoms present at 80 wt % to 100 wt % of the polyoxyalkylene glycol.

In one embodiment the oil soluble polyalkylene glycol comprises a homopolymer of polypropylene glycol.

In one embodiment the oil soluble polyalkylene glycol may be Synalox® propylene glycol. The Synalox® polyalkylene glycol is typically a homopolymer or copolymer of propylene oxide. The Synalox® polyalkylene glycol is described in more detail in a product brochure with Form No. 118-01453-0702 AMS, published by The Dow Chemical Company. The product brochure is entitled "SYNALOX Lubricants, High-Performance Polyglycols for Demanding Applications." Specific commercially available Synalox® polyalkylene glycols include 100-D450, Synalox 100-120B. Other commercially available polyalkylene glycol useful for the invention are sold under the trademark UCON™ base stocks including UCON™ LB-525, LB-625, LB-1145, and LB-1715. Examples of other available polyoxyalkylene glycol compounds include Actaclear™ND-21 available from Bayer, Emkarox®VG-222, Emkarox®VG-127W, Emkarox®VG-132W (all Emkarox products available from Uniquema), or various oil-soluble Pluracol® products available from BASF.

In one embodiment the oil soluble polyalkylene glycol comprises a block (A-B-A type) copolymer of (propylene glycol-ethylene glycol-propylene glycol).

The oil soluble polyalkylene glycol may be formed by processes known to a person skilled in the art.

In one embodiment the hydroxyl-capped polyoxyalkylene glycol is obtained/obtainable by a process that comprises reacting (i) an alkylene oxide, (ii) water and optionally an alcohol, and (iii) a base catalyst, by a process known to a person skilled in the art.

The hydrocarbyl-capped polyoxyalkylene glycol may be prepared by basic catalysis. U.S. Pat. Nos. 4,274,837, 4,877,416, and 5,600,025 disclose the use of alkali metals such as potassium as a basic catalyst for making hydrocarbyl-capped polyoxyalkylene glycol.

In one embodiment the hydrocarbyl-capped polyoxyalkylene glycol may be prepared using a double metal cyanide catalyst. Suitable double cyanide catalysts are described in U.S. Pat. Nos. 3,278,457, 3,941,849, 4,472,560, 5,158,922, 5,470,813, and 5,482,908.

Examples of a suitable base catalyst include alkaline-metal hydroxides, alkaline earth-metal hydroxides, Lewis bases, and double metal-cyanide complexes.

In one embodiment the polyoxyalkylene glycol may be prepared using a zinc hexacyanocobaltate-tert-butyl alcohol complex as disclosed in U.S. Pat. No. 6,821,308.

The reaction may be carried out a reaction temperature range of 50° C. to 150° C., or 100° C. to 120° C.

The reaction may be carried out at atmospheric pressure between 10 kPa to 3000 kPa (or 0.1 bar to 30 bar), or 50 kPa to 1500 kPa (or 0.5 bar to 15 bar).

The base catalyst may be removed or neutralised by techniques including acid neutralization, ion exchange, adsorption of metals, or mixtures thereof.

The initiator is typically water and/or an alcohol. The alcohol includes either a monohydric alcohol or a polyhydric alcohol. Examples of a suitable polyhydric alcohol include ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. Examples of a monohydric alcohol include methanol, ethanol, propanol, butanol, pentanol, hexanol, heptanol, octanol, 2-ethylhexanol, nonanol, decanol, undecanol, dodecanol, tridecanol, tetradecanol, pentadecanol, hexadecanol, heptadecanol, octadecanol, nonadecanol, eicosanol, or mixtures thereof.

In different embodiments linear monohydric alcohol includes methanol, butanol, or mixtures thereof. In particular linear monohydric alcohol includes butanol.

In one embodiment the monohydric alcohol is linear and contains 1 to 40 carbon atoms. In one embodiment the monohydric alcohol is branched and contains 1 to 60 carbon atoms.

In one embodiment the monohydric alcohol is linear and contains 11 to 40 carbon atoms.

In one embodiment the monohydric alcohol is branched and contains 6 to 40 carbon atoms.

In different embodiments a suitable linear monohydric alcohol includes mixtures of $C_{12-15}$ alcohol, or $C_{8-10}$ alcohols, In one embodiment branched monohydric alcohols include 2-ethylhexanol, or isotridecanol, Guerbet alcohols, or branched alcohols of the Formula R'R"$CHCH_2OH$, or mixtures thereof.

Examples of suitable groups for R' and R" on the formula defined above include the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$polymethylene group, such as 2-$C_{1-15}$ alkyl-tetradecyl groups (e.g. 2-hexyltetradecyl, 2-decyltetradecyl and 2-undecyltridecyl) and 2-$C_{1-15}$alkyl-hexadecyl groups (e.g. 2-ethyl-hexadecyl and 2-dodecylhexadecyl);

3) alkyl groups containing $C_{10-12}$polymethylene group, such as 2-$C_{1-15}$ alkyl-dodecyl groups (e.g. 2-octyldodecyl) and 2-$C_{1-15}$alkyl-dodecyl groups (2-hexyldodecyl and 2-octyldodecyl), 2-$C_{1-15}$alkyl-tetradecyl groups (e.g. 2-hexyltetradecyl and 2-decyltetradecyl);

4) alkyl groups containing $C_{6-9}$polymethylene group, such as 2-$C_{1-15}$ alkyl-decyl groups (e.g. 2-octyldecyl and 2,4-di-$C_{1-15}$ alkyl-decyl groups (e.g. 2-ethyl-4-butyl-decyl group);

5) alkyl groups containing $C_{1-5}$polymethylene group, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio of 16:1-1:11) oligomers, isobutene oligomers (from pentamer to octamer), $C_{5-17}$ $\alpha$-olefin oligomers (from dimer to hexamer).

In one embodiment the hydrocarbyl-capped polyoxyalkylene glycol in mono-capped.

The monohydric alcohol typically forms a capping group on the hydrocarbyl-capped polyoxyalkylene glycol.

In different embodiments the hydrocarbyl-capped group of the polyoxyalkylene glycol comprises a residue of a linear or branched monohydric alcohol containing 6 to 40, or 6 to 30, or 8 to 20 carbon atoms.

In different embodiments the hydrocarbyl-capped group of the polyoxyalkylene glycol comprises a residue of a branched monohydric alcohol containing 6 to 60, or 8 to 50, or 8 to 30, or 8 to 12 carbon atoms. The branching may occur at any point in the chain and the branching may be of any length.

Examples of a branched monohydric alcohol containing 6 or more carbon atoms include 2-ethylhexanol.

In different embodiments the hydrocarbyl-capped group of the polyoxyalkylene glycol comprises a residue of a linear monohydric alcohol containing 1 to 60, or 11 to 60, or 11 to 30, or 12 to 20, or 12 to 18 carbon atoms.

In different embodiments the oil soluble polyalkylene glycol may be a $C_1$-$C_8$ (typically butanol) monocapped polyalkylene glycol selected from the following compositions:

(i) 0 wt % to 40 wt % ethylene oxide (or ethylene glycol); and 60 wt % to 100 wt % propylene oxide (or propylene glycol);

(ii) 0 wt % to 20 wt % ethylene oxide (or ethylene glycol); and 80 wt % to 100 wt % propylene oxide (or propylene glycol);

(iii) 0 wt % to 10 wt % ethylene oxide (or ethylene glycol); and 90 wt % to 100 wt % propylene oxide (or propylene glycol);

(iv) 100 wt % propylene oxide (or propylene glycol); and (v) a block A-B-A type copolymer comprising 25 wt % to 40 wt % propylene oxide (or propylene glycol); 20 wt % to 50 wt % ethylene oxide (or ethylene glycol); and 25 wt % to 40 wt % propylene oxide (or propylene glycol).

In one embodiment the oil soluble polyalkylene glycol is a homopolymer.

The oil soluble polyalkylene glycol described herein may have a distribution of molecular weight such that the molecules thereof have a weight of 1400 to 7000, or 3000 to 7000 Daltons.

The oil-soluble polyalkylene glycol of the present invention may comprise a component of a polyalkylene glycol that has 10 mole % to 100 mole %, or 20 mole % to 90 mole %, or 30 mol % to 80 mole %, or 40 mole % to 75 mole % within the weight of 2500 to less than 10,000 (or 2750 to 9000, or 3000 to 8000, or 3000 to 7000) Daltons as specified by the present invention.

Without being bound by theory it is believed that a distribution of molecular weight of below that presently claimed may not be as efficient at thickening the lubricating composition disclosed herein. In contrast, a distribution of molecular weight of above that presently claimed may be as too efficient at thickening the lubricating composition disclosed herein causing in many instances gelation or a composition that is too viscous to measure.

Other Performance Additives

The lubricating composition optionally contains at least one other performance additive. Typically the other performance additives include detergents (other than the sulphonate of the present invention), metal deactivators, dispersant, antioxidants, antiwear agents, corrosion inhibitors, antiscuffing agents, extreme pressure agents, foam inhibitors, demulsifiers, friction modifiers, viscosity modifiers, pour point depressants and mixtures thereof. Typically, fully-formulated lubricating oil will contain one or more of these performance additives.

In one embodiment the lubricating composition further comprises at least one detergent selected from the group consisting of a salicylate, a salixarate, a phenate, a phenate-salicylate, and a phenate-stearate.

The total amount of detergent in the lubricating composition may be 0 wt % to 50 wt %, or at least 5 wt % to 35 wt %, or 6.5 wt % to 32 wt %, or 9 wt % to 30 wt %, or 12 wt % to 28 wt % of the lubricating composition.

Optionally the lubricating composition further includes a phenate detergent. The phenate detergent is known and includes neutral and overbased metal salts of a sulphur-containing phenate, a non-sulphurised phenate or mixtures thereof. Suitable metal salts are the same as those described for the sulphonate detergent.

The phenate detergent in one embodiment has a TBN from 30 to 450, in another embodiment 30 to 350 or 290, in another embodiment 40 to 265, in another embodiment 50 to 190 and in another embodiment 70 to 175. In one embodiment the sulphur containing phenate detergent has a TBN of 150, in another embodiment a TBN of 225 and in another embodiment 250.

The detergent may also be a hybrid (or complex) detergent. In one embodiment the complex/hybrid may be an overbased phenate-stearate detergent, typically with a TBN of 300 to 450. Methods of preparing overbased phenate-stearate detergents are disclosed in EP 271262 B1 and EP273 588 B1.

In one embodiment the complex/hybrid may be an overbased phenate-salicylate detergent. Methods of preparing overbased phenate-salicylate detergents are disclosed in EP 123 6791 A1 and EP 123 6792 A1.

In one embodiment the complex/hybrid may be prepared by reacting, in the presence of the suspension and acidifying overbasing agent, alkyl aromatic sulphonic acid and at least one alkyl phenol (such as, alkyl phenol, aldehyde-coupled alkyl phenol, sulphurised alkyl phenol) and optionally alkyl salicylic acid.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with weight average molecular weight of the polyisobutylene substituent in the range 250 to 5000, or 500 to 3000. Succinimide dispersants and their preparation are disclosed, for instance in U.S. Pat. No. 3,172,892 or U.S. Pat. No. 4,234,435. Succinimide dispersants are typically the imide formed from a polyamine, typically a poly(ethyleneamine).

In one embodiment the invention further comprises at least one dispersant derived from polyisobutylene succinimide with number average molecular weight in the range 250 to 5000, or 500 to 3000. The polyisobutylene succinimide may be used alone or in combination with other dispersants.

In one embodiment the invention further comprises at least one dispersant derived from polyisobutylene succinic anhydride, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present from 0 wt % to 5 wt %, or 0 wt % to 3 wt %, or 0 wt % to 2 wt %, or 0.1 wt % to 2 wt %.

Antioxidants

Antioxidant compounds are known and include for example, sulphurised olefins, alkylated diphenylamines (typically di-nonyl diphenylamine, octyl diphenylamine, di-octyl diphenylamine), hindered phenols, molybdenum compounds (such as molybdenum dithiocarbamates), or mixtures thereof. Antioxidant compounds may be used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 and S-600 from Asahi Denka Kogyo K. K and mixtures thereof.

Viscosity Modifiers

Viscosity modifiers include hydrogenated copolymers of styrene and butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, esters of maleic anhydride-styrene copolymers.

Antiwear Agents

The lubricant composition optionally further comprises at least one antiwear agent (other than the various other components mentioned herein that may also impart some antiwar functionality). The antiwear agent may be present in ranges including 0 wt % to 15 wt %, or 0.1 wt % to 10 wt % or 1 wt % to 8 wt % of the lubricating composition. Examples of suitable antiwear agents include a boron-containing compound such as borate esters or borate alcohols, phosphate esters, sulphurised olefins, sulphur-containing ashless anti-wear additives are metal dihydrocarbyldithiophosphates (such as zinc dialkyldithiophosphates or molybdenum dialkyldithiophosphates), thiocarbamate-containing compounds, such as thiocarbamate esters, alkylene-coupled thiocarbamates, and bis-(S-alkyldithiocarbamyl)disulphides.

The borate esters or borate alcohols may be substantially the same except the borate alcohol has at least one hydroxyl group that is not esterified. Therefore, as used herein the term "borate ester" is used to refer to either borate ester or borate alcohol. The borate esters or borate alcohols may have a formula $B(OR')_3$ or be a derivative thereof containing a >B—O—B< group, wherein R' may be hydrogen or a hydrocarbyl group, typically containing 1 to 40, or 1 to 20 carbon atoms on each R'. When R' is hydrogen, the boron-containing compound is a borate alcohol. When R' is hydrogen, the boron-containing compound is a borate alcohol. When R' is hydrocarbyl, the boron-containing compound is a borate ester.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal.

The borate ester may be prepared by blending the boron compound and the epoxy compounds or alcohols described above and heating them at a suitable temperature, such as at 80° C. to 250° C., 90° C. to 240° C., or 100° C. to 230° C., until the desired reaction has occurred. The molar ratio of the boron compounds to the epoxy compounds is typically 4:1 to 1:4, or 1:1 to 1:3, or 1:2. An inert liquid may be used in performing the reaction. The liquid may be, for instance, toluene, xylene, chlorobenzene, dimethylformamide and mixtures thereof. Water is typically formed and is distilled off during the reaction. Alkaline reagents may be used to catalyze the reaction.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent (which may also be described as a friction modifier) may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the ashless antiwear agent mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentacrythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Other performance additives such as corrosion inhibitors include octylamine octanoate, condensation products of dodecenyl succinic acid or anhydride and a fatty acid such as oleic acid with a polyamine.

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Friction modifiers including fatty acid derivatives such as amines, esters, epoxides, fatty imidazolines, condensation products of carboxylic acids and polyalkylene-polyamines and amine salts of alkylphosphoric acids, fatty alkyl tartrates, fatty alkyl tartrimides, fatty alkyl tartramides may also be used in the lubricant composition. Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid (all these friction modifiers have been described above as antioxidants or antiwear agents).

Industrial Application

The method and lubricating composition of the invention may be suitable for 2-stroke internal combustion engines. Typically the 2-stroke engine may be a 2-stroke cross-head engine.

The power output of the engine may be at least 2000 kilowatts, or at least 3000 kilowatts, or at least 4700 kilowatts.

The 2-stroke internal combustion engine may be a marine diesel engine or a stationary power engine.

In one embodiment the engine may be marine-diesel internal combustion engine is a 2-stroke engine.

In one embodiment the 2-stroke engine employs the lubricating composition in a cylinder liner (and piston).

The following examples provide illustrations of the invention. These examples are non-exhaustive and are not intended to limit the scope of the invention.

EXAMPLES

Marine Diesel Cylinder Lubricants: Invention and Reference Lubricating Oil Compositions Lubricating oil compositions are prepared as summarised in Table 1 below. The amounts of sulphonate, phenate and dispersant quoted include the normal amounts of diluent oil associated with additives. Typically the sulphonate, phenate and dispersant contain about 40 wt % of diluent oil. Each lubricant is blended to about 19.5 $mm^2/s$ (as measured by ASTM D445 at 100° C.) to meet the requirements of SAE 50, and the TBN is 70 mg KOH/g.

Reference oil composition 1 (RF1) is a lubricant containing bright stock (150 BS) and no polyalkyene glycol. Reference oil compositions 2 (RF2) and 3 (RF3) contain different polyalkylene glycol outside the scope of the claimed invention. The lubricating oil compositions of the invention 1 (LC1) and 6 (LC6) contain a polyalkylene glycol of the present invention (and summarized below Table 1).

The viscosity change as a result of addition of polyalkylene oxide is determined by ASTM D445 at 100° C.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

TABLE 1

| Formulation Components | RF1 | RF2 | RF3 | LC1 | LC2 Parts | LC3 | LC4 | LC5 | LC6 |
|---|---|---|---|---|---|---|---|---|---|
| 400 TBN calcium sulphonate | 14.5 | 14.5 | 14.5 | 14.5 | 14.5 | 14.5 | 14.5 | 14.5 | 14.5 |
| Calcium phenate | 5.8 | 5.8 | 5.8 | 5.8 | 5.8 | 5.8 | 5.8 | 5.8 | 5.8 |
| Succinimide Dispersant | 1.5 | 1.5 | 1.5 | 1.5 | 1.5 | 1.5 | 1.5 | 1.5 | 1.5 |
| Antifoam Agent | 0.03 | 0.03 | 0.03 | 0.03 | 0.03 | 0.03 | 0.03 | 0.03 | 0.03 |
| Ucon ™ LB-165 | | 0.5 | | | | | | | |
| Ucon ™ LB-285 | | | 0.5 | | | | | | |
| Ucon ™ LB-625 | | | | 0.5 | | | | | |
| Synalox ®100-120B | | | | | 0.2 | | | | |
| Synalox ®100-120B | | | | | | 0.5 | | | |
| Synalox ®100-120B | | | | | | | 1 | | |
| Synalox ®100-D450 | | | | | | | | 0.5 | |
| PPG-PEG-PPG | | | | | | | | | 0.5 |
| Thickening Viscosity End of Test ($mm^2/s$)_ | 180 | 146 | 162 | 214 | 240 | 291 | 296 | 436 | 348 |

Footnote:

Synalox ® 100-120B propylene oxide homopolymer initiated with butanol, and a distribution of molecular weight of 4176, commercially available from Dow Chemicals.

Synalox ®100-D450 propylene oxide homopolymer initiated with butanol, and a distribution of molecular weight of 52.2% 16,038; 43.9% 4,606; 2.4% 741; and 1.1% 412), commercially available from Dow Chemicals Ucon ™ LB-285 propylene oxide homopolymer initiated with butanol, and a distribution of molecular weight of 1861, commercially available from Dow Chemicals.

PPG-PEG-PPG is a block polypropylene glycol (PEG)-polyethylene glycol (PEG)-polypropylene glycol (PEG) copolymer initiated with butanol, and a distribution of molecular weight of 3176.

Overall the data indicates that a lubricating composition of the present invention may be capable of providing at least one property from control of viscometrics, increased thickening, acceptable deposit accumulation, reduced wear, reduced corrosion (typically lead or copper), acceptable oxidative stability and a partial or complete replacement for current viscosity modifiers or bright stock.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a cylinder liner and piston of a 2-stroke internal combustion engine with a power output of at least 1600 kilowatts comprising supplying to the engine a lubricating composition comprising:

an oil of lubricating viscosity;

4.5 wt % to 20 wt %, exclusive of any solvent or diluent oil, of a detergent, wherein said detergent is an overbased calcium sulphonate detergent with a TBN of about 400; and 0.2 wt % to 1 wt % of an oil-soluble polyalkylene glycol comprising a homopolymer or block polymer of propylene oxide and a distribution of molecular weight such that 10 mole % to 100 mole % of the molecules thereof have a weight of 2500 to less than 10,000 Daltons.

2. The method of claim 1, wherein the cylinder liner and piston is a marine diesel cylinder liner and piston.

3. The method of claim 1, wherein the oil-soluble polyalkylene glycol has a distribution of molecular weight such that 10 mole % to 100 mole % of the molecules thereof have a weight of 2750 to 9000 Daltons.

4. The method of claim 1, wherein the oil-soluble polyalkylene glycol comprises a block polymer of propylene oxide with a portion of oxyalkylene groups derived from ethylene oxide.

5. The method of claim 1, wherein the oil of lubricating viscosity has a SAE grade of SAE 40 or SAE 50 oil.

6. The method of claim 1, wherein the calcium delivered by the sulphonate detergent is in the range at 500 to 5000 ppm of the lubricating composition.

* * * * *